US009458392B2

(12) United States Patent
Zhang et al.

(10) Patent No.: US 9,458,392 B2
(45) **Date of Patent: *Oct. 4, 2016**

(54) HYDROCARBON TREATMENT PROCESS

(71) Applicant: MERICHEM COMPANY, Houston, TX (US)

(72) Inventors: Tiejun Zhang, Bellaire, TX (US); K. Michael Hardy, Humble, TX (US); V. Keith Turner, LaPorte, TX (US); Ignacio C. Bincaz, Houston, TX (US); Tom Varadi, Houston, TX (US)

(73) Assignee: MERICHEM COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/530,931

(22) Filed: Nov. 3, 2014

(65) Prior Publication Data

US 2015/0048006 A1 Feb. 19, 2015

Related U.S. Application Data

(63) Continuation of application No. 13/017,861, filed on Jan. 31, 2011, now Pat. No. 8,900,446, which is a continuation-in-part of application No. 12/627,520, filed on Nov. 30, 2009.

(51) Int. Cl.

| | |
|---|---|
| ***C10G 27/06*** | (2006.01) |
| ***C10G 27/10*** | (2006.01) |
| ***C10G 17/00*** | (2006.01) |
| ***C10G 19/04*** | (2006.01) |

(52) U.S. Cl.

CPC ..... *C10G 27/10* (2013.01); *C10G 17/00* (2013.01); *C10G 19/04* (2013.01); *C10G 27/06* (2013.01); *C10G 2300/1033* (2013.01); *C10G 2300/202* (2013.01); *C10G 2300/301* (2013.01); *C10G 2300/805* (2013.01)

(58) Field of Classification Search

CPC ..... C10G 19/00; C10G 19/02; C10G 19/04; C10G 27/04; C10G 27/06; C10G 53/00; C10G 53/02; C10G 53/12; C10G 53/14; C10G 2300/10

USPC ..... 208/189, 203, 204

See application file for complete search history.

(56) References Cited

U.S. PATENT DOCUMENTS

| | | | |
|---|---|---|---|
| 2,651,595 | A | 5/1950 | Moulthrop |
| 3,130,149 | A | 4/1964 | Hoover |
| 3,565,959 | A | 2/1971 | Takase et al. |
| 3,586,622 | A | 6/1971 | Thompson et al. |
| 3,992,156 | A | 11/1976 | Clonts |

(Continued)

OTHER PUBLICATIONS

International Search Report and Written Opinion for Int. App. No. PCT/US2012/023238, completed Oct. 8, 2012.

(Continued)

*Primary Examiner* — Michelle Stein

(74) *Attorney, Agent, or Firm* — McDonnell Boehnen Hulbert & Berghoff LLP

(57) ABSTRACT

In a catalytic treatment process, mercaptans in sour hydrocarbon are oxidized to disulfide oils using an aqueous treatment solution containing a chelated polyvalent metal catalyst, alkali metal hydroxide, and the alkali metal salt of at least one alcohol in a non-dispersive mixing apparatus wherein an upgraded hydrocarbon containing the disulfide oils is produced.

8 Claims, 1 Drawing Sheet

(56) References Cited

U.S. PATENT DOCUMENTS

| | | | |
|---|---|---|---|
| 3,997,829 | A | 12/1976 | Suzaki et al. |
| 4,141,819 | A | 2/1979 | Carlson |
| 4,700,004 | A | 10/1987 | MacDonell et al. |
| 4,753,722 | A | 6/1988 | Le et al. |
| 4,897,180 | A | 1/1990 | Bricker et al. |
| 5,961,819 | A | 10/1999 | Lee et al. |
| 6,860,999 | B2 | 3/2005 | Greaney et al. |
| 6,960,291 | B2 | 11/2005 | Greaney et al. |
| 7,014,751 | B2 | 3/2006 | Greaney et al. |
| 7,029,573 | B2 | 4/2006 | Greaney et al. |
| 7,223,332 | B1 | 5/2007 | Tertel |
| 8,900,446 | B2 * | 12/2014 | Zhang ..... C10G 17/00 208/189 |
| 2003/0052046 | A1 | 3/2003 | Greaney et al. |
| 2003/0188992 | A1 | 10/2003 | Halbert et al. |
| 2009/0065434 | A1 | 3/2009 | Zhang |

OTHER PUBLICATIONS

Freudenrich, How Oil Refining Works, Accessed from <http://science.howstuffworks.com/environmental/energy/oil-oilrefining2.htm> on Jun. 5, 2013.

* cited by examiner

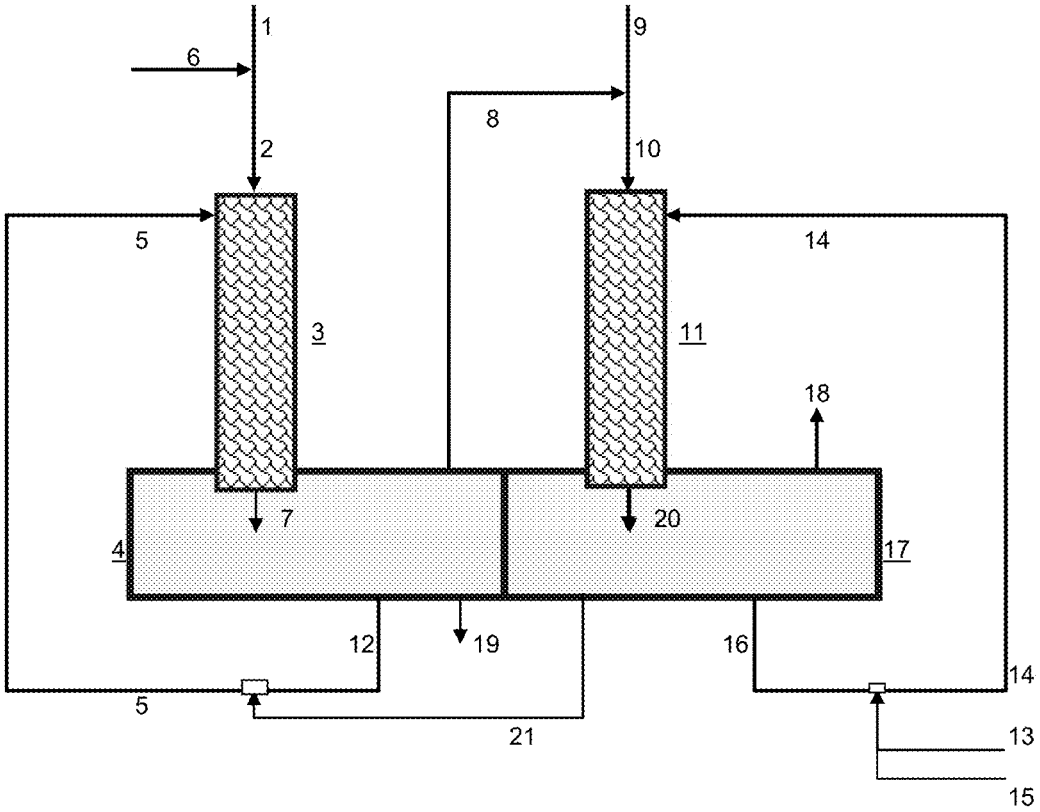
1
6
2
9
8
10
5
14
3
11
18
7
20
4
17
12
19
16
14
5
21
13
15

HYDROCARBON TREATMENT PROCESS

CROSS REFERENCE TO RELATED APPLICATIONS

The present application is a is a continuation of U.S. patent application Ser. No. 13/017,861, filed Jan. 31, 2011, which is a continuation-in-part of U.S. patent application Ser. No. 12/627,520 filed Nov. 30, 2009, the entire contents of which are incorporated herein by reference.

FIELD OF INVENTION

The invention relates to a method for treating liquid hydrocarbons in order to convert acidic impurities, such as mercaptans, to less odorous sulfur compounds. More specifically these impurities are oxidized to disulfide oils by contacting the hydrocarbon in the presence of oxygen with an aqueous treatment solution comprising a polyvalent chelated metal catalyst, an alcohol and an alkali metal hydroxide. An especially preferred treatment solution also includes a carboxylic acid.

BACKGROUND

The treatment of liquid hydrocarbons containing undesirable acidic species such as mercaptans is known and can be performed using either an extraction or a conversion process. The conversion processes are known as "sweetening" processes where an aqueous solution containing a mixture of an alkali metal hydroxide, such as sodium hydroxide, and a chelated metal catalyst is contacted with a hydrocarbon stream in the presence of an oxygen containing gas. An oxidation reaction occurs that converts the mercaptans to disulfide oils, which remain in the hydrocarbon phase during a subsequent step to separate the hydrocarbon from the aqueous solution. These sweetening processes work effectively on light hydrocarbon feeds with light mercaptan impurities.

The extraction processes, such as described in U.S. Pat. Nos. 6,860,999; 6,960,291; 7,014,751; and 7,029,573, requires liquid-liquid mass transfer of the mercaptans from the hydrocarbon to an aqueous solution under anaerobic conditions, i.e., in the substantial absence of added oxygen. Such processes were especially effectively for removal of high molecular weight mercaptans ($C_4$ and higher) that are typically contained in heavier liquid hydrocarbon feeds. The aqueous solution preferably has two phases where alkylphenols, such as cresols (in the form of the alkali metal salt), are combined with a polyvalent metal catalyst, and an alkali metal hydroxide in an aqueous extractant phase and a denser aqueous bottom phase that is substantially immiscible in the extractant. The alkylphenols were used to enhance the extraction of the heavier mercaptans. The metal catalyst is included in the solution to minimize entrainment of the aqueous solution in the treated hydrocarbon, particularly at the higher viscosities encountered at higher alkali metal hydroxide concentration. During mixing with a "sour" liquid hydrocarbon feed, the mercaptans are physically extracted (not converted) into the aqueous extractant phase, and after separation an upgraded hydrocarbon product is obtained that is substantially lower than the feed in mercaptan content. The extractant phase aqueous solution is then sent to an oxidation process where an oxygen containing gas is added and the metal catalyst present in the solution converts the mercaptans to disulfides. These alkylphenol based extraction processes are more complicated and difficult to operate principally because of the need to use a two-phase aqueous extraction solution, or a single phase compositionally located at the phase boundary between the one and two-phase regions.

There remains a need, therefore, for new hydrocarbon treatment processes that minimize operational difficulty and minimize the need for secondary processes to treat sulfur contaminants.

SUMMARY

Our invention is directed to an improved liquid hydrocarbon treatment process that combines the best of a conventional sweetening process with that of the more complicated extraction processes. Our process converts (as opposed to extracts) mercaptans including higher molecular weight mercaptans ($C_4$ and higher) to disulfide oils using an aqueous treatment solution and an oxidation reaction. The disulfide oils remain in the separated hydrocarbon product stream removed from the process. More specifically, our invention involves a process comprising a method for treating a hydrocarbon containing mercaptans where the liquid hydrocarbons containing mercaptans are combined with an oxygen containing gas to form a feed stream. That feed is contacted with an aqueous treatment solution comprising water, alkali metal hydroxide, a polyvalent chelated metal catalyst, and at least one alcohol, preferably having atmospheric boiling points of 100° C. to 210° C., in a contactor vessel, where the catalyst and oxygen are used to convert the mercaptans via an oxidation reaction to disulfide oils. The contacting step forms a product admixture that is directed to at least one separation zone, where an upgraded hydrocarbon stream containing the disulfide oils is separated from the admixture. The aqueous treatment solution is recirculated to treat more sour hydrocarbon, when necessary, after being replenished with make-up catalyst and/or other ingredients of the treatment solution.

In another embodiment, our invention involves a two-stage method for treating a hydrocarbon containing mercaptans, comprising, mixing a liquid hydrocarbon with air to form a first feed, then contacting the first feed in a first stage contactor with an aqueous treatment solution comprising water, alkali metal hydroxide, a chelated polyvalent metal catalyst, and at least one alcohol, preferably having atmospheric boiling points of 100° C. to 210° C. The presence of the oxygen from the air and the catalyst oxidize most of the mercaptans in the first feed to disulfide oils to form a first admixture. This admixture is then settled in a first separation zone, where an upgraded hydrocarbon stream is separated that contains the disulfide oils from the settled first admixture. The separated upgraded hydrocarbon stream is then mixed with additional air to form a second feed. This second feed is further contacted in a second stage contactor with a second stream of the aqueous treatment solution to oxidize any remaining mercaptans to disulfide oils to form a second admixture. The second admixture is settled in a second separation zone, where a second upgraded hydrocarbon stream containing the disulfide oils is separated and removed from the process as a product stream. Similar steps may be repeated for the third and fourth stages, if needed.

Preferably, the contacting steps are performed using a contactor that reduces aqueous phase entrainment. Such contactors are configured to cause little or no agitation. One such contacting method employs a mass transfer apparatus comprising substantially continuous elongate fibers mounted in a shroud. The fibers are preferentially wetted by the aqueous treatment solution, and consequently present a large surface area to the hydrocarbon without substantial dispersion of the aqueous phase in the hydrocarbon.

The catalyst composition of our invention is preferably a liquid chelated polyvalent metal catalyst solution. Polyvalent catalysts include, but are not limited to, metal phthalocyanines, wherein the metal cation is selected from the group consisting of manganese (Mn), iron (Fe), cobalt (Co), nickel (Ni), copper (Cu), zinc (Zn), ruthenium (Ru), rhodium (Rh), palladium (Pd), silver (Ag) etc. Catalyst concentration is from about 10 to about 10,000 ppm, preferably from about 20 to about 4000 ppm. The particular catalyst selected may be included during preparation of the treatment solution and/or later added to the solution at the place of its use.

The aqueous treatment solution of this invention also includes one or more alcohols that have atmospheric boiling points of from 80° C. to 225° C. These alcohols include, but are not limited to, methanol, ethanol, 1-propanol, 2-propanol, 2-methyl-1 propanol, 2-methyl-2-butanol, cyclohexanol, phenol, cresols, xylenols, hydroquinone, resorcinol, catechol, benzyl alcohol, ethylene glycol, propylene glycol. When mixed with an alkali metal hydroxide, an alkali metal salt of the alcohol is formed, preferably in a concentration of from about 5 to about 40 wt %, most preferably from about 10 to about 35 wt %. One type of preferred alcohol is an aromatic alcohol, which are compounds represented by a general formula of aryl-OH. The aryl can be phenyl, thiophenyl, indolyl, tolyl, xylyl, and alike. Preferred aromatic alcohols include phenol, cresols, xylenols, methylethyl phenols, trimethyl phenols, naphthols, alkylnaphthols, thiophenols, alkylthiophenols, and similar phenolics. Non-aromatic alcohols can be primary, secondary or tertiary alcohols, including methanol, ethanol, n-propanol, iso-propanol, cyclohexanol, 2-methyl-1-propanol, 2-methyl-2-butanol. A mixture of different alcohols can also be used. The preferred alcohols have an atmospheric boiling point of from about 100° C. to about 210° C. The preferred alkali metal salts of alcohol include, but are not limited to, potassium cyclohexoxide, potassium iso-propoxide, dipotassium propylene glycoxide, potassium cresylates and mixtures thereof.

In a most preferred treatment solution formulation, one or more carboxylic acids are included. Such acids include, but are not limited to, fatty acids, naphthenic acids, amino acids, keto acids, alpha hydroxy acids, dicarboxylic acids, and tricarboxylic acids. These acids also react with the alkali metal hydroxides to produce their alkali metal salts in concentrations from about 0 to about 40 wt %, preferably from about 5 to about 25 wt %. In general, the carboxylic acids can include alkanoic acids and naphthenic acids, where the alkanoic acids are represented by R—COOH, where R is a hydrogen or an alkyl group ranging from CH3- (i.e. acetic acid) to CH3(CH2)18- (i.e. arachidic acid). Naphthenic acids are a mixture of multiple cyclopentyl and cyclohexyl carboxylic acids with their main fractions preferably having a carbon backbone of 9 to 20 carbons. A mixture of multiple carboxylic acid compounds can also be used as part of the treatment solution.

The aqueous treatment solution of this invention contains an alkali metal hydroxide selected from lithium hydroxide (LiOH), sodium hydroxide (NaOH), potassium hydroxide (KOH), rubidium hydroxide (RbOH), and cesium hydroxide (CsOH). The alkali metal hydroxide is present at a concentration that is more than sufficient to ensure all alcohols and carboxylic acids to form their corresponding alkali metal salts. Sodium hydroxide and especially potassium hydroxide are preferred.

Contacting of hydrocarbon feed with the aqueous treatment solution can be accomplished by any liquid-liquid mixing device, such as packed tower, bubble tray, stirred vessel, plug flow reactor, etc. Preferably, the contacting is performed using a contactor that achieves rapid liquid-liquid mass transfer without causing difficulties in obtaining quick and clean phase separation between the hydrocarbon and the aqueous treatment solution. Such contactors are configured to cause little or no agitation and reduce entrainment of aqueous solution in the hydrocarbon. One such contacting method employs a mass transfer apparatus comprising substantially continuous elongated fibers mounted in a shroud. The fibers are preferentially wetted by the aqueous treatment solution to form a thin film on the surface of fibers, and consequently present a large surface area to the hydrocarbon without substantial dispersion of the aqueous phase in the hydrocarbon. The rapid liquid-liquid mass transfer is enabled by both the large surface area and the functionality of the aqueous solution, which in turn enables the mercaptans to be transferred from the hydrocarbon to contacting with the thin film of the aqueous treatment solution. As mentioned earlier, two or more stages of contacting with an aqueous treatment solution may be adopted to achieve a greater extent of treating efficiency.

Any number of hydrocarbon feeds with boiling point up to about 350° C. can be treated in our process using our aqueous treatment solution, including, but not limited to, kerosene, jet fuel, diesel, light and heavy naphtha. Other feedstocks may include straight run or cracked or selectively hydrotreated, LPG, naphtha, crude, crude condensates, and the like materials. Still another possible feedstock that can be used in the process of our invention would include crude oil, ranging from raw crude oil (i.e., untreated and straight out of ground) to partially or fully treated crudes that have been desalted and/or dewatered and/or de-odorized and mixtures of these. These so-called pipeline-ready crudes or refinery ready crude oil at the end of pipeline transportation can be used in our process as the liquid hydrocarbon feed. By the method of our invention, mercaptans in crude oil with 95 wt % boiling points of up to 600° C. are converted into disulfide oils, prior to any fractionation.

These and other embodiments will become more apparent from the detail description of the preferred embodiment contained below.

BRIEF DESCRIPTION OF THE FIGURES

FIG. 1 schematically illustrates a process flow diagram for one possible embodiment of this invention.

DETAILED DESCRIPTION

As mentioned, our invention involves treating a sour liquid hydrocarbon stream containing mercaptans by an oxidation process where the hydrocarbons are contacted with an oxygen containing gas and mixed with an aqueous treatment solution in a contactor to convert the mercaptans to disulfide oils, which remain in the hydrocarbon. An upgraded hydrocarbon stream (containing the disulfide oils) is separated from the aqueous treatment solution and removed from the process. In another embodiment, as disclosed more fully below, the process includes at least two stages of contacting, oxidation and separation.

The hydrocarbons treated in our process are liquid with a boiling point up to about 350° C. and contain acidic species such as mercaptans. Representative hydrocarbons include straight run or cracked or selectively hydrotreated, one or more of natural gas condensates, liquid petroleum gas (LPG), butanes, butenes, gasoline streams, jet fuels, kerosenes, diesels, naphthas and the like. An example hydrocarbon is a cracked naphtha, such as FCC naphtha or coker naphtha, boiling in the range of about 35° C. to about 230° C. Such hydrocarbon streams can typically contain one or more mercaptan compounds, such as methyl mercaptan, ethyl mercaptan, n-propyl mercaptan, isopropyl mercaptan, n-butyl mercaptan, thiophenol and higher molecular weight mercaptans. The mercaptan compound is frequently represented by the symbol RSH, where R is normal or branched alkyl, or aryl. The mercaptan sulfur is present in the hydrocarbons in an amount ranging from about 20 ppm to about 4000 ppm by weight, depending on the liquid hydrocarbon stream to be treated. The mercaptans range in molecular weight upwards from about $C_4$ or $C_5$, and may be present as straight chain, branched, or both. Specific types of mercaptans which may be converted to disulfide material by the oxidation process of this invention will include methyl mercaptan, ethyl mercaptan, propyl mercaptan, butyl mercaptan, pentyl mercaptan, hexyl mercaptan, heptyl mercaptan, octyl mercaptan, nonyl mercaptan, decyl mercaptan, undecyl mercaptan, dodecyl mercaptan, tridecyl mercaptan, tetradecyl mercaptan, pentadecyl mercaptan, hexadecyl mercaptan, heptadecyl mercaptan, octadecyl mercaptan, nonadecyl mercaptan, various mercaptobenzothiazoles, hydroxy mercaptans such as mercaptoethanol, cysteine, aromatic mercaptans such as thiophenol, methyl-substituted thiophenol isomers, ethyl-substituted thiophenol isomers, propyl-substituted thiophenol isomers, etc.

In some cases, the hydrocarbons to be treated in our process have been hydrotreated to remove undesirable sulfur species and other heteroatoms from cracked naphtha. Unfortunately, hydrogen sulfide formed during hydrotreating reacts with olefins to form mercaptans, which are referred to as reversion or recombinant mercaptans to distinguish them from the mercaptans present in the cracked naphtha conducted to the hydrotreater. Such reversion mercaptans generally have a molecular weight ranging from about 90 to about 160 g/mole, and generally exceed the molecular weight of the mercaptans formed during heavy oil, gas oil, and resid cracking or coking, as these typically range in molecular weight from 48 to about 76 g/mole. The higher molecular weight of the reversion mercaptans and the branched nature of their hydrocarbon component make them more difficult to remove from the naphtha using conventional caustic extraction.

Our improved oxidation process using an aqueous treatment solution containing at least one alcohol and an alkali metal hydroxide can treat a hydrotreated naphtha boiling in the range of about 55° C. to about 180° C. and containing reversion mercaptan sulfur in an amount ranging from about 10 to about 100 wppm, based on the weight of the hydrotreated naphtha. Likewise, our process can treat a selectively hydrotreated hydrocarbon, i.e., one that is more than 80 wt. % (more preferably 90 wt. % and still more preferably 95 wt. %) desulfurized compared to the hydrotreater feed but with more than 30% (more preferably 50% and still more preferably 60%) of the olefins retained based on the amount of olefin in the hydrotreater feed.

Unlike prior known processes that use a two-phase treatment solution in the absence of oxygen, our process uses an aqueous treatment solution in conjunction with an added oxygen-containing gas that causes the mercaptans in the hydrocarbon feed to oxidize to disulfide oils, which remain in the hydrocarbon phase. The treatment solution can be prepared by adding metal phthalocyanine catalyst to an aqueous solution of alkali metal hydroxide and at least one alcohol. Another preferred treatment solution further contains at least one carboxylic acid, such as naphthenic or ethylhexanoic acid.

FIG. 1 included herein schematically illustrates only one of the possible process flow schemes useful for performing the process of converting sulfur compounds found in a hydrocarbon stream taught by the invention. The process of our invention will be described in detail in conjunction with a description of the illustrated flow scheme. Before turning to the figure in detail, however, it should be understood that while the particular arrangement of unit operations shown in the figure may be used to covert sulfur containing impurities to less obnoxious sulfur compounds, those skilled in the art will readily appreciate how to modify the flow schemes to permit the catalytic oxidation of sulfur compounds in liquid hydrocarbon feed streams.

FIG. 1 shows a two-stage process where a liquid hydrocarbon feed containing mercaptans 1 is mixed with an oxygen containing gas stream 6, such as air. This mix 2 is then fed to contactor 3, where the air/hydrocarbon mix is contacted with stream 5, which contains an aqueous treatment solution of this invention. The contacting between the treatment solution and the hydrocarbon is liquid-liquid and can be accomplished in conventional contacting equipment, such as packed tower, bubble tray, stirred vessel, fiber contacting, rotating disc contactor or other contacting apparatus. As illustrated, a FIBER FILM® contactor 3, sold by the Merichem Company, is preferred. Such contactors are characterized by large surface areas provided by a mass of hanging thin ribbons of metal or other materials contained in a vertical shroud that allows mass transfer in a non-dispersive manner. These type of contactors are described in U.S. Pat. Nos. 3,997,829; 3,992,156; and 4,753,722. While contacting temperature and pressure may range from about 0° C. to about 150° C. and from 0 psig to about 500 psig, preferably the contacting occurs at a temperature in the range of about 25° C. to about 100° C. and a pressure in the range of about 0 psig to about 300 psig. When the hydrocarbon feed has a low atmospheric boiling point, higher pressures during contacting may be desirable to ensure that the contacting with the hydrocarbon occurs in the liquid phase.

During the contacting step the mercaptans are oxidized to disulfide oils that ultimately remain in the hydrocarbon phase. The admixture of hydrocarbon and treatment solution 7 exits the bottom of contactor 3 and is directed to a first separation zone 4 where the liquid hydrocarbon containing the disulfide oils is allowed to separate from the aqueous treatment solution via gravity settling. The separated upgraded liquid hydrocarbon is removed via line 8 and then combined with a second air stream 9 to form stream 10 that enters a second FIBER FILM® contactor 11. The air/hydrocarbon mix in stream 10 is combined with a second stream of treatment solution 14. Treatment solution streams 5 and 14 comprise recycled treatment solutions removed from separation zones 4 and 17 and make-up fresh treatment solution 13 and catalyst 15. A portion of the treatment solution is removed from the first separation zone 4 as stream 19 for disposal and from the second separation zone 17 as stream 21 to be mixed with stream 12. Any remaining mercaptans in the hydrocarbon are further oxidized in the second contactor 11 to disulfide oils. Admixture 20 is directed from contactor 11 into separation zone 17 where a product hydrocarbon stream 18 containing the disulfide oils is removed from the process.

The foregoing description of the specific embodiments will so fully reveal the general nature of the invention that others can, by applying current knowledge, readily modify and/or adapt for various application such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

The various aspects of the present invention will be more fully understood and appreciated by reference to the following examples. These examples not only demonstrate the interrelationship between the aqueous treatment solution of our invention used in the process taught by the invention and certain process variables, but also the significantly improved effectiveness of the present invention in reducing mercaptan sulfur compound concentrations in contaminated feed streams, as compared to prior art processes.

EXAMPLES

Four sets of comparison experiments are provided to demonstrate the enhanced treating efficiency of the aqueous treatment solution of our invention. In the first set, conventional caustic solutions are used to treat a sour jet fuel for sweetening. In the second set, one embodiment of our treatment solution is shown to substantially improve the treating efficiency. In the third set, five different compositions of our treatment solution are used to treat the sour jet fuel to show that the treating efficiency is further substantially improved by including a carboxylic acid.

The treating (i.e. sweetening) efficiency of a treating solution was experimentally determined in a laboratory bench-top batch reactor. A sour jet fuel feed having boiling point of 123° C. to 343° C. was obtained from a refinery plant. To each volume of an aqueous treating solution in a batch reactor, five volumes of this sour hydrocarbon were charged and the contents were mixed. The reactor content was kept at 38° C. in the presence of oxygen that exceeded the stoichiometric requirement for full oxidation of mercaptans into disulfide oil. After a designated length of reaction time, the hydrocarbon phase was separated from the aqueous phase and analyzed to determine its mercaptan concentration. The mercaptan concentration as a function of reaction time was correlated with a kinetic rate equation to determine oxidation rate constant.

The performance advantage of the test treatment solutions is represented by an enhancement factor, E, that is substantially greater 1. The enhancement factor is defined as the ratio of the rate constant obtained with a treatment solution of our invention to the rate constant obtained with conventional 15 wt % NaOH under identical conditions. In other words, the enhancement factor represents the extent of improvement in treating efficiency relative to 15 wt % NaOH.

Examples 1-3

In commercially practiced sweetening technologies, sodium hydroxide solution are conventionally used as the aqueous treating solution. Potassium hydroxide solution is rarely used for this purpose. Nevertheless, three caustic solutions were prepared to contain 15 wt % NaOH, 22 wt % KOH and 35 wt % KOH, respectively. Each solution was added with the same concentration of a cobalt phthalocyanine catalyst and tested to treat a sample of sour kerosene containing 38 ppm weight of mercaptan sulfur. The results of enhancement factors, E, are listed in Table 1. The cobalt phthalocyanine catalyst is commercially marketed by Merichem.

By definition, the 15 wt % NaOH solution has an enhancement factor, E, of 1.0. Table 1 illustrates that the 22 wt % KOH treatment solution did not change the enhancement factor and offers essentially the same treating efficiency as the 15 wt % NaOH solution. Increasing the caustic strength to 35 wt % KOH yielded a slight improvement of the enhancement factor to 3.5, indicating that a more concentrated KOH solution does, to some extent, enhance the treating efficiency as compared to 15 wt % NaOH.

TABLE 1

| Example | Aqueous Solution | Enhancement Factor, E |
|---|---|---|
| Example 1 | 15 wt % NaOH | 1.0* |
| Example 2 | 22 wt % KOH | 1.0** |
| Example 3 | 35 wt % KOH | 3.5** |

*By definition;
**Relative to 15 wt % NaOH.

Example 4

This example shows the advantage of an aqueous solution of this invention that contains a polyvalent catalyst, an aromatic alcohol, and an alkali metal hydroxide. 125.2 grams of 45% potassium hydroxide, 36.8 grams of cresol, and 37.2 grams of water were mixed thoroughly. The resulting solution contained 24.9 wt % potassium cresylate and 18.6 wt % free potassium hydroxide. To this aqueous solution was added 0.80 gram of cobalt phthalocyanine catalyst.

The treatment solution as prepared above was tested to treat a sample of sour jet fuel containing about 38 ppm weight of mercaptan sulfur and enhancement factors were calculated and reported in Table 2.

TABLE 2

| Example | Enhancement Factor, E |
|---|---|
| Example 14 | 15.3 |

Table 2 shows that the aqueous treatment solution of our invention provides an enhancement factor of 15.3. In other words, the sweetening of the jet fuel is 15 times faster when it is treated with the aqueous solution of this invention as compared to 15 wt % NaOH.

Examples 5-9

These examples show that the effectiveness of the treatment solutions of this invention is further substantially improved by including a carboxylic acid in the presence of an alcohol. Naphthenic acid and ethylhexanoic acid are examples of carboxylic acids. Cyclohexanol, iso propanol, propylene glycol and alkylphenol are examples of such alcohols.

Example 5

125.2 grams of 45% potassium hydroxide, 34.2 grams of cyclohexanol, 34.2 grams of naphthenic acid, and 5.6 grams of water were mixed thoroughly. The resulting solution contained 23.6 wt % potassium cyclohexoxide, 13.5 wt % free potassium hydroxide, and 20.6 wt % potassium naphthenate. To this solution was added 0.80 gram of cobalt phthalocyanine catalyst.

Example 6

125.2 grams of 45% potassium hydroxide, 20.4 grams of iso-propanol, 34.2 grams of naphthenic acid, and 19.3 grams of water were mixed thoroughly. The resulting solution contained 16.7 wt % potassium iso-propoxide, 13.5 wt % free potassium hydroxide, and 20.6 wt % potassium naphthenate. 0.80 gram of cobalt phthalocyanine catalyst was added to the solution.

Example 7

125.2 grams of 45% potassium hydroxide, 26.0 grams of propylene glycol, 34.2 grams of naphthenic acid, and 13.9 grams of water were mixed thoroughly. The resulting solution contained 25.9 wt % dipotassium propylene glycoxide, 13.5 wt % free potassium hydroxide, and 20.6 wt % potassium naphthenate. 0.80 gram of cobalt phthalocyanine catalyst was added to the solution.

Example 8

125.2 grams of 45% potassium hydroxide, 36.8 grams of a mixed cresylic acid that contained 23 wt % phenol, 49 wt % cresols, 17 wt % xylenols, 7 wt % ethylphenols and 3 wt % trimethylphenol, 34.2 grams of naphthenic acid, and 3.0 grams of water were mixed thoroughly. The resulting solution contained 24.9 wt % potassium cresylates, 13.5 wt % free potassium hydroxide, and 20.6 wt % potassium naphthenate. 0.80 gram of cobalt phthalocyanine catalyst was added to the solution.

Example 9

125.2 grams of 45% potassium hydroxide, 36.8 grams of cresol, 26.4 grams of ethylhexanoic acid, and 10.8 grams of water were mixed thoroughly. The resulting solution contained 24.9 wt % potassium cresylate, 13.5 wt % free potassium hydroxide, and 16.7 wt % potassium ethylhexanoate. 0.80 gram of cobalt phthalocyanine catalyst was added to the solution.

The aqueous treatment solutions of Examples 5 to 9 were individually tested with a sample of sour jet fuel containing about 38 ppm weight of mercaptan sulfur. The results of enhancement factors are listed in Table 3. As Table 3 clearly shows, the aqueous treatment solutions of our invention provides enhancement factors of from 33.6 to 75.7. In other words, as compared to 15 wt % NaOH, the sweetening of the jet fuel is 34 to 76 faster when it is treated with the treatment solutions of our invention as compared to 15 wt % NaOH.

TABLE 3

| Example | Enhancement Factor, E |
|---|---|
| Example 5 | 51.1 |
| Example 6 | 42.0 |
| Example 7 | 71.5 |
| Example 8 | 75.7 |
| Example 9 | 33.6 |

Examples 10-11

The essential role of alcohol and alkali metal hydroxide in the aqueous treatment solutions of this invention is shown in Examples 10 to 11.

Example 10

117.3 grams of 30% ammonium hydroxide, 36.8 grams of cresol, 34.2 grams of naphthenic acid, and 10.9 grams of water were mixed thoroughly. The resulting solution contained 21.3 wt % ammonium cresylate, 8.4 wt % free ammonium hydroxide, and 18.7 wt % ammonium naphthenate. 0.80 gram of cobalt phthalocyanine catalyst was added to the solution.

Example 11

125.2 grams of 45% potassium hydroxide, 34.2 grams of naphthenic acid, and 39.8 grams of water were mixed thoroughly. The resulting solution contained 23.0 wt % free potassium hydroxide and 20.6 wt % potassium naphthenate. 0.80 gram of cobalt phthalocyanine catalyst was added to the solution.

The solutions of Examples 10 to 11 were individually tested to treat a sample of sour jet fuel containing about 38 ppm weight of mercaptan sulfur. The results of enhancement factors are listed in Table 4. Table 4 illustrates that a substitution of alkali metal hydroxide with ammonium hydroxide (Example 10) or the absence of alcohol (Example 11) results in a great loss of treating efficiency, with enhancement factors dropped to 0.7 and 5.1, respectively. This is in sharp contrast to enhancement factors of 33.6 to 75.7 for the aqueous treatment solutions of this invention as presented in Table 3.

TABLE 4

| Example | Enhancement Factor, E |
|---|---|
| Example 10 | 0.7 |
| Example 11 | 5.1 |

Example 12

This example demonstrates the execution of treating a sour jet fuel using an aqueous solution of this invention in a pilot scale FIBER FILM® Contactor in comparison to conventional 15 wt % NaOH solution. FIBER FILM® Contactor is a proprietary non-dispersive liquid-liquid mass transfer device invented and commercialized by Merichem as indicated by multiple US patents. The sour jet fuel contained 26 ppm weight of mercaptan sour. When conventional 15 wt % NaOH was used, the jet fuel was treated to 18 ppm weight of mercaptan sulfur or a 31% reduction. In contrast, when an aqueous treatment solution of this invention was used, the jet fuel was treated to 2 ppm weight of mercaptan sulfur or a 92% reduction.

The means, materials, and steps for carrying out various disclosed functions may take a variety of alternative forms without departing from the invention. Thus, the expressions "means to . . . " and "means for . . . ", or any method step language as may be found in the specification above or the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same function can be used; and it is intended that such expressions be given their broadest interpretation within the terms of the following claims.

The invention claimed is:

1. A method for treating a crude oil feed containing mercaptans, comprising a continuous mercaptan treatment process having the following steps, (a) continuously mixing a feed consisting essentially of crude oil, where the crude oil contains mercaptans, with an oxygen containing gas to form a liquid-gas mix and continuously feeding the mix to a top portion of a vertical shroud containing vertically hanging non-porous fibers while simultaneously and continuously feeding an aqueous liquid treatment solution to the shroud where the liquid treatment solution combines with the liquid-gas mix to form a 100% liquid-gas admixture prior to the admixture co-currently flowing down the vertical hanging fibers, where the liquid treatment solution consisting essentially of a 100% liquid solution of water, alkali metal hydroxide, a liquid chelated polyvalent metal catalyst solution, and at least one alkali metal salt of an alcohol;

(b) catalytically oxidizing the mercaptans to disulfide oil in the presence of the crude oil using only the liquid treatment solution as the 100% liquid-gas admixture flows down the vertical hanging fibers; and (c) continuously separating and recovering the crude oil and disulfide oil as an upgraded crude oil product from the aqueous treatment solution and oxygen containing gas.

2. The method of claim 1 where the aqueous liquid treatment solution separated from the crude oil product and disulfide oil in step (c) is fed to the top portion of the vertical shroud in step (a).

3. The method of claim 1 where the aqueous liquid treatment solution separated from the hydrocarbon and disulfide oil in step (c) is mixed with fresh make-up treatment solution and the resultant mix is fed to the vertical shroud in step (a).

4. The method of claim 1 where the recovery of the crude oil product and disulfide oil in step (c) comprises separating the aqueous liquid treatment solution fed to the vertical shroud in step (a) from the crude oil product and disulfide oil in a separation zone.

5. The method of claim 1 wherein the crude oil has 95 wt. % boiling points of up to 600° C.

6. The method of claim 1 wherein the crude oil feed is mixed with an oxygen source prior to contact with the liquid treatment solution.

7. The method of claim 4 further characterized in that recovered crude oil and disulfide oil from the separation zone contains residual mercaptans, where the recovered crude oil, disulfide oil and residual mercaptans are mixed with an oxygen containing gas and aqueous liquid treatment solution to form a second liquid-gas mix that is fed to a top portion of a second vertical shroud containing vertically hanging fibers where the aqueous liquid treatment solution combines with separated crude oil and disulfide to form a second 100% liquid-gas admixture that co-currently flows down the vertical hanging fibers in the second shroud, wherein the residual mercaptans are oxidized to disulfide oil as the second 100% liquid-gas admixture flows down the hanging fibers in the second shroud and, wherein the recovered crude oil and disulfide oil is separated as a mixture in a second separation zone.

8. The method of claim 7 where the aqueous liquid treatment solution that combines with separated crude oil and disulfide to form a second 100% liquid-gas admixture comprises a mixture of fresh make-up treatment solution and recycled aqueous treatment solution from step (c).

* * * * *